US006477349B2

(12) United States Patent
Kanekura et al.

(10) Patent No.: US 6,477,349 B2
(45) Date of Patent: Nov. 5, 2002

(54) COLOR IMAGE FORMING APPARATUS INCLUDING MECHANISM WHICH PROVIDES TENSION TO AN INTERMEDIATE TRANSFER BELT

(75) Inventors: Kazunori Kanekura, Fukuoka (JP); Naoki Yamaguchi, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/854,103

(22) Filed: May 11, 2001

(65) Prior Publication Data

US 2002/0003977 A1 Jan. 10, 2002

(30) Foreign Application Priority Data

May 11, 2000 (JP) ..... 2000-138659

(51) Int. Cl.[7] ..... G03G 15/01
(52) U.S. Cl. ..... 399/302; 399/313

(58) Field of Search ..... 399/298, 299, 399/301, 302, 307, 308, 310, 313, 314

(56) References Cited

U.S. PATENT DOCUMENTS 5,794,111 A * 8/1998 Tombs et al. ..... 399/302
5,930,556 A * 7/1999 Imamiya ..... 399/299 X
5,966,561 A * 10/1999 Yamaguchi et al. .... 399/302 X

FOREIGN PATENT DOCUMENTS

JP 11-59947 3/1999

* cited by examiner

*Primary Examiner*—William J. Royer
(74) *Attorney, Agent, or Firm*—RatnerPrestia

(57) ABSTRACT

Utilizing an action of a transfer roller transferring a toner image formed on an intermediate transfer belt onto a sheet of paper can provide the belt with tension, and allows the belt and an urging roller to nip the sheet of paper. Thanks to this structure, a compact and inexpensive color image forming apparatus is obtainable.

2 Claims, 7 Drawing Sheets

COLOR IMAGE FORMING APPARATUS INCLUDING MECHANISM WHICH PROVIDES TENSION TO AN INTERMEDIATE TRANSFER BELT

FIELD OF THE INVENTION

The present invention relates to a color image forming apparatus which transfers a color image onto a sheet of paper via an intermediate transfer belt. More particularly, it relates to the color image forming apparatus including a new mechanism which provides an intermediate transfer belt with tension, so that a number of components can be reduced and the apparatus can be downsized.

BACKGROUND OF THE INVENTION

A conventional image forming apparatus employing electro-photographic technique forms an image through the following steps: First, charge a photosensitive body—an image carrying body—with a charger, second, photo-radiate the photosensitive body responsive to image information for depositing a latent image. Then develop the latent image with a developing device for forming a toner image. Finally, transfer the toner image onto a recording sheet such as a sheet of paper to form a visible image.

Recently, color images have become popular in the market, and a number of images forming apparatuses employing a tandem style have been proposed. One of these apparatuses includes a plurality of image-carrying-bodies on which a series of image forming processes are carried out. Images of respective colors including cyan, magenta, yellow and preferably black are formed on each image-carrying-body, and images of respective colors are overlaid for transferring so that a full color image can be formed. This kind of image forming apparatus includes an image forming unit for each color, and this structure is advantageous to an operation at higher speed.

FIG. 7 is a cross section illustrating an essential part of a conventional color image forming apparatus. In FIG. 7, image forming units 502, 503, 504 and 505 are disposed in this order within apparatus 501. These units 502–505 form toner images of yellow, magenta, cyan and black respectively. Apparatus 501 includes exposure devices 561, 562, 563 and 564 corresponding to units 502–505. These units 502–505 include photosensitive drums 521, 531, 541 and 551, as well as developing rollers 522, 532, 542 and 552. These photosensitive drums function as image-carrying-bodies for depositing electrostatic latent images on their surfaces by laser-beam-radiation from exposure devices 561–564. Developing rollers 522, 532, 542 and 552 attach toner supplied from toner tanks to those photosensitive drums thereby revealing the electrostatic latent images to visible toner images.

Under units 502–505 arrayed, intermediate-transfer-belt 507 circulates in an arrow marked direction passing by four first-transfer-rollers 591, 592, 593 and 594, driving roller 508, tension roller 550 and second-transfer-roller 510. The first-transfer-rollers correspond to respective photosensitive drums, and the second-transfer-roller transfers an image to a sheet of paper.

Under belt 507, paper tray 520 is disposed. Paper P supplied from tray 520 is nipped between belt 507 around second-transfer-roller 510 and urging roller 560 confronting second-transfer-roller 510. On the surface of belt 507, toner images in yellow, magenta, cyan and black are attached by drums 521, 531, 541 and 551, thereby forming a color image. This toner color image is transferred on paper P by nipping force yielded between rollers 510 and 560. Then paper P is fed to fixing device 580 thereby fixing the toner image. Finally, paper P is discharged.

Driving roller 508 and second-transfer-roller 510 are both rigidly disposed, and tension roller 550 is specifically disposed in order to provide belt 507 with tension. In FIG. 7, during a printing period, tension roller 550 is biased by a spring (not shown) and moves down right, thereby providing belt 507 with tension. During a non-printing period, on the other hand, the tension provided by roller 550 to belt 507 is released in order to avoid curling of belt 507 due to long time rolling around respective rollers.

As discussed above, a given tension is provided to belt 507, so that drums 521, 531, 541 and 551 transfer a toner image onto belt 507, and second-transfer-roller 510 transfers the toner image onto paper P.

However, tension roller 550 is prepared only for providing belt 507 with the tension, and this not only increases a number of components, but also blocks downsizing the apparatus. The cost of the apparatus tends to increase. A tension providing/releasing mechanism to/from belt 507 is additionally required, which further makes it difficult to downsize the apparatus.

Urging roller 560 is away from second-transfer-roller 510 during the non-printing period, and it moves rightward to nip paper P together with roller 510 during the printing period. During the non-printing period, urging roller 560 is kept away from belt 507 so that it will not contact with belt 507 for extending a service life of belt 507 by avoiding a local stress.

This removal mechanism of urging roller 560 from second-transfer-roller 510 is additionally required, which increases the cost and also blocks downsizing the apparatus.

The conventional color image forming apparatus not only requires tension roller 550, but also needs a driving mechanism for providing/releasing the tension to/from belt 507 as well as the removal mechanism for removing urging roller 560 from second-transfer-roller 510. These components boost the cost and blocks downsizing the apparatus.

SUMMARY OF THE INVENTION

The present invention addresses the problems discussed above and aims to provide a compact and inexpensive color image forming apparatus which utilizes movement of a transfer roller, thereby allowing to provide an intermediate-transfer-belt with tension.

The color image forming apparatus of the present invention comprises the following elements:

(a) a, plurality of image forming units which have respective photosensitive bodies carrying toner images and form images of different colored toners;

(b) a loop type intermediate-transfer-belt, disposed allowable to contact with a photosensitive body, and on which a toner image is transferred;

(c) a transfer roller, disposed in the loop of the intermediate-transfer-belt, for transferring the toner image formed on the intermediate-transfer-belt to a recording sheet;

(d) a driving roller, disposed in the loop and facing the transfer roller, for rotating the intermediate-transfer-belt.

The transfer roller provides the intermediate-transfer-belt with tension.

Another color image forming apparatus of the present invention comprises the following elements:

(a) a plurality of image forming units which have respective photosensitive bodies carrying toner images and form images of different colored toners;

(b) a loop type intermediate-transfer-belt, disposed allowable to contact with a photosensitive body, and on which a toner image is transferred;

(c) a plurality of first-transfer-rollers, disposed in the loop of the intermediate-transfer-belt, for biasing the intermediate-transfer-belt to the photosensitive body;

(d) a second-transfer-roller, disposed in the loop, for transferring a toner image on the intermediate-transfer-belt; and (e) a driving roller, disposed in the loop and facing the second-transfer-roller, for rotating the intermediate-transfer-belt.

The intermediate-transfer-belt is rotatably held only by the second-transfer-roller and the driving roller, and only the second-transfer-roller provides the belt with tension.

These structures can provide the belt with tension by shifting the transfer-roller (the first case discussed above) or shifting the second-transfer-roller (the second case discussed above), and save a tension roller included in the conventional apparatus and reduces a number of components as well as achieves easy assembly. These structures also contribute to downsizing and reducing the cost of the apparatus.

DETAILED DESCRIPTION OF EXAMPLARY EMBODIMENT

An exemplary embodiment of the present invention is demonstrated hereinafter with reference to the accompanying drawings.

Figure 1:
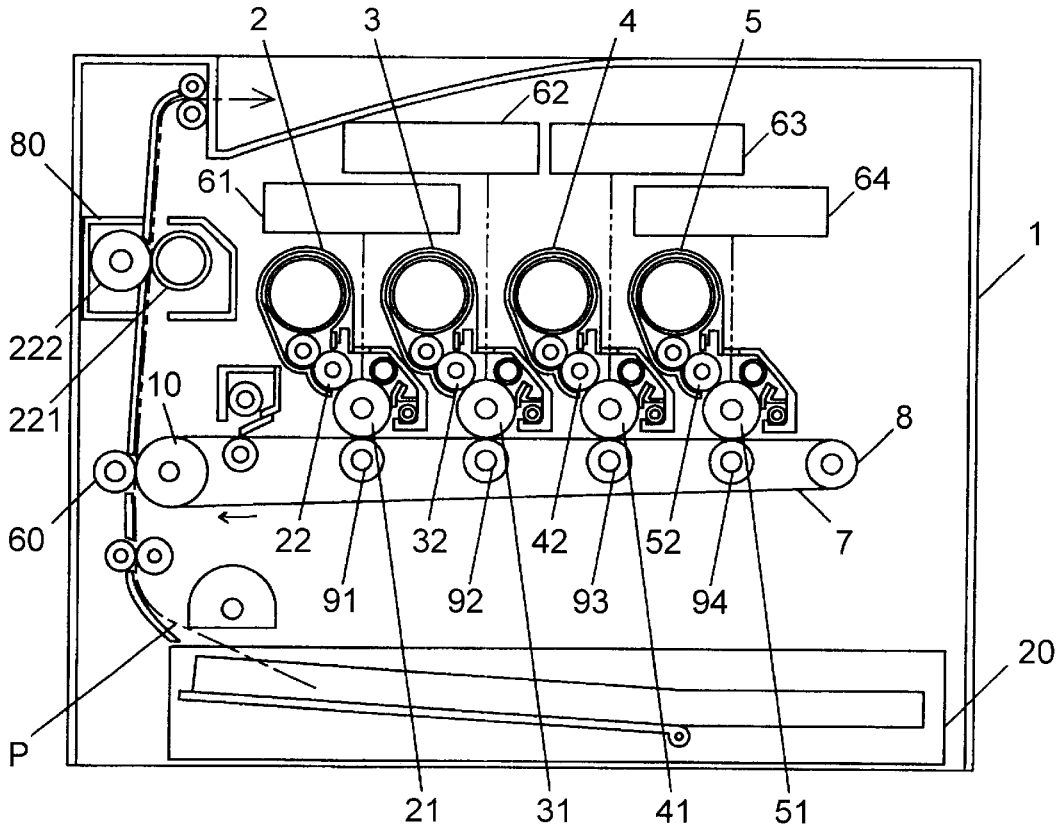
FIG. 1 is a cross section illustrating an essential part of a color image forming apparatus in accordance with an exemplary embodiment of the present invention.

In FIG. 1, in apparatus 1, image-forming-units 2, 3, 4 and 5 are disposed in this order for forming toner images of yellow, magenta, cyan and black. Exposure devices 61, 62, 63, and 64 are disposed corresponding to units 2–5 respectively. Units 2–5 include photosensitive drums 21, 31, 41 and 51, and developing rollers 22, 32, 42 and 52. Each photosensitive drum deposits an electrostatic latent image on its surface by laser beam radiated from each exposure device, i.e., functioning as an image carrying body. Each developing roller attaches toner supplied from a toner tank to each photosensitive drum, thereby revealing an electrostatic latent image as a visible toner image.

Under units 2–5 arrayed, loop type intermediate-transfer-belt 7 circulates in an arrow marked direction passing by four first-transfer-rollers 91, 92, 93 and 94, driving roller 8, and second-transfer-roller 10. The first-transfer-rollers correspond to respective photosensitive drums 21, 31, 41 and 51, and the second-transfer-roller transfers an image to a recording sheet such as a sheet of paper. The four first-transfer-rollers, second-transfer-roller and the driving roller are placed in the loop of belt 7, and second-transfer-roller 10 and driving roller 8 confront each other at opposite ends of belt 7.

Under belt 7 a paper tray 20 is disposed. Paper P supplied from tray 20 is nipped between belt 7 around roller 10 and urging roller 60 confronting second-transfer-roller 10. Toner images formed on belt 7 are transferred onto-paper P. Then paper P is fed to fixing device 80 thereby fixing the toner image. Finally, paper P is discharged.

On the surface of belt 7, toner images in yellow, magenta, cyan and black are attach ed by drums 21, 31, 41 and 51, thereby forming a color image. This toner color image is transferred onto paper P by nipping force yielded between rollers 10 and 60.

Figure 7:
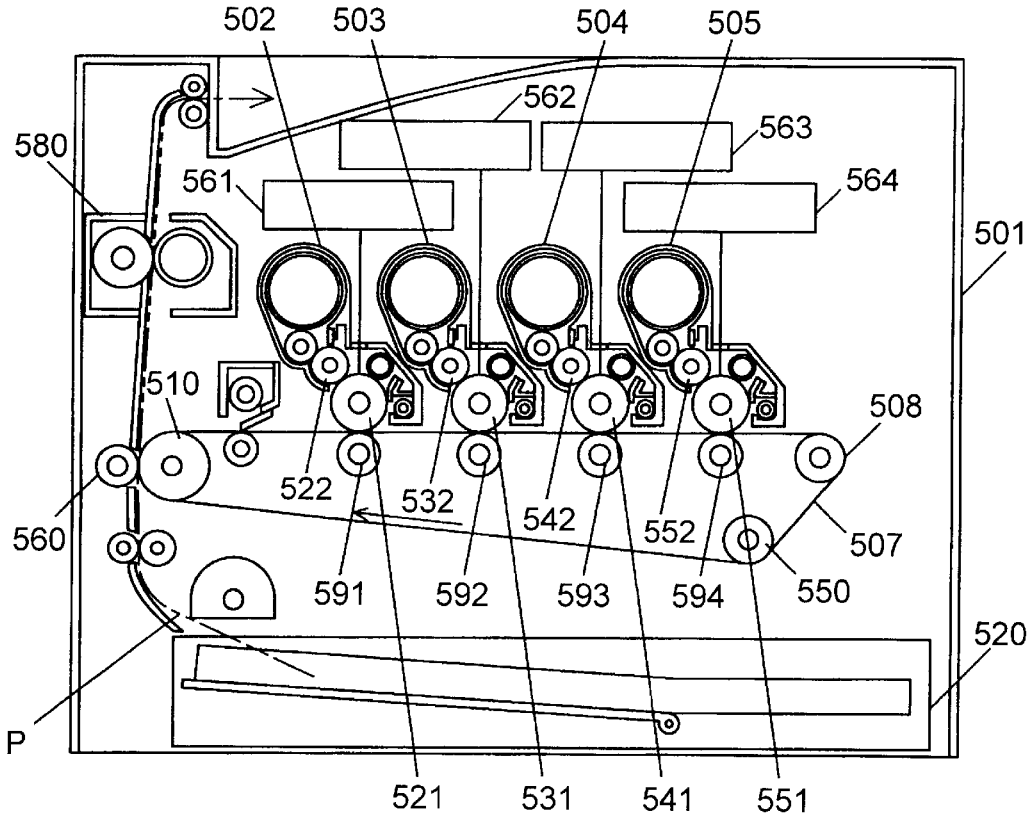
FIG. 7 PRIOR ART
FIG. 7 is a cross section showing an essential part of a conventional color image forming apparatus.

Belt 7 is wound on first-transfer-rollers 91, 92, 93 and 94, driving roller 8, and second-transfer-roller 10. In other words, the present invention saves tension roller 550 of the conventional case shown in FIG. 7, and changes the position of second-transfer-roller 10, thereby providing belt 7 with tension and removing/contacting roller 10 from/to urging roller 60. Driving roller 8, first transfer-rollers 91–94, second-transfer-roller 10 and belt 7 form one unit, and the unit can be detached from a chassis (not shown) built in the apparatus 1.

Figure 2:
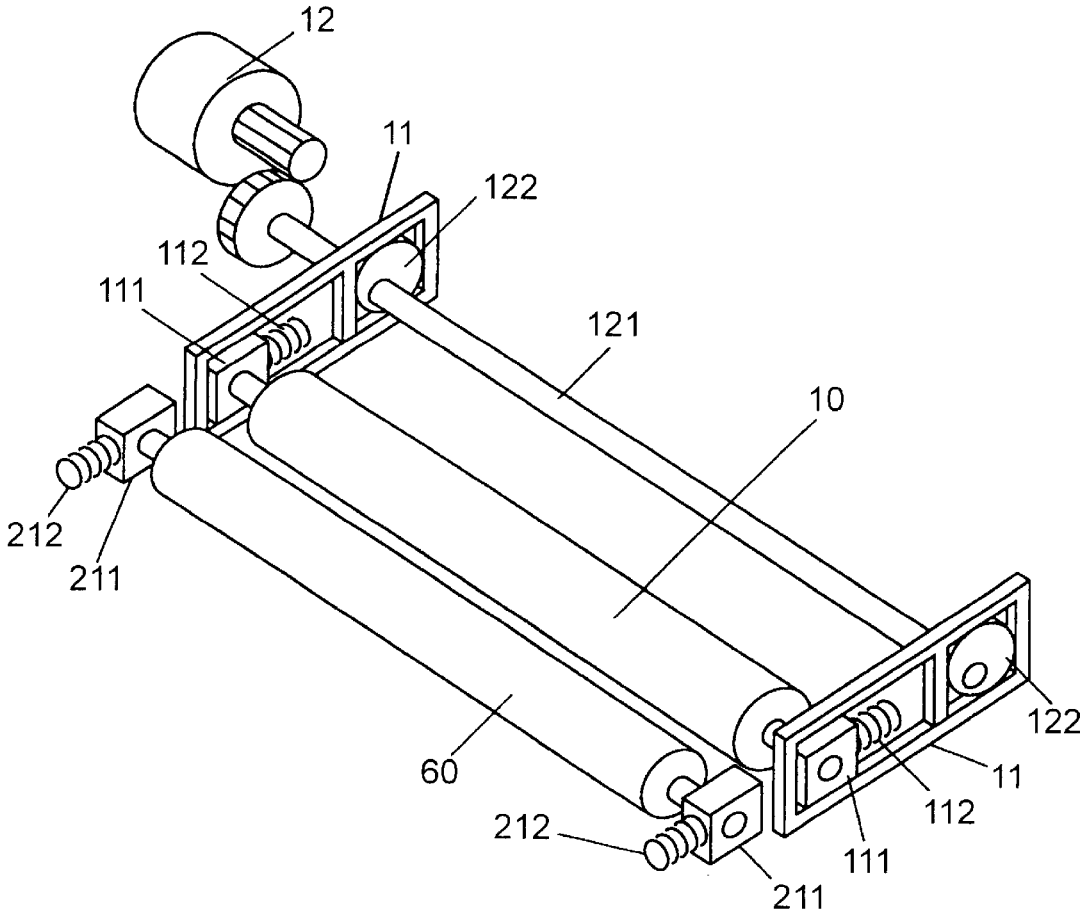
FIG. 2 is a schematic perspective view illustrating a shift mechanism of a second-transfer-roller of the apparatus shown in FIG. 1.
Figure 3A:
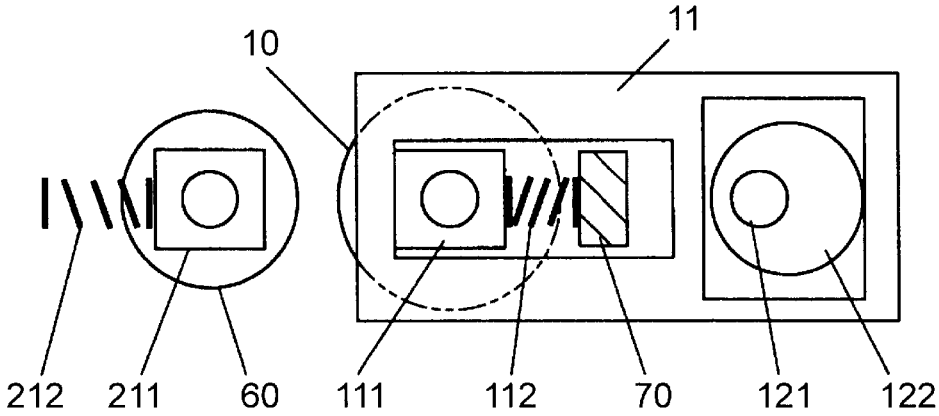
FIG. 3A is a lateral view illustrating a positional relation between the second-transfer-roller held by a holder and an urging roller of the apparatus shown in FIG. 1.
Figure 3B:
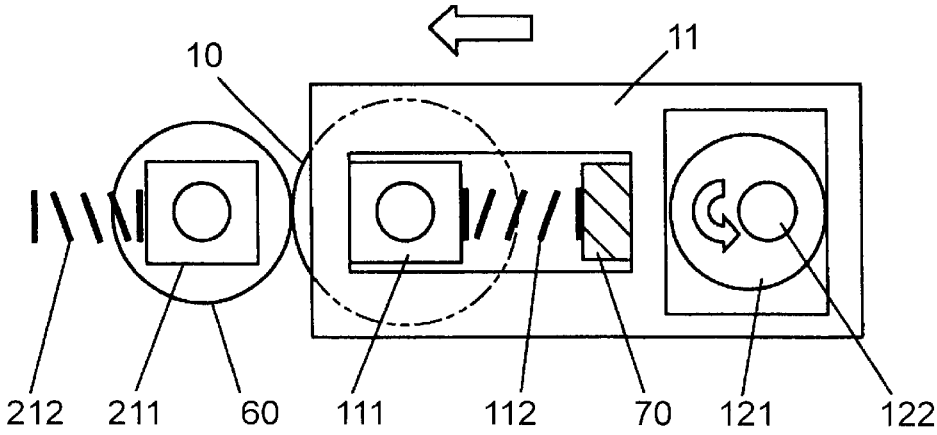
FIG. 3B is a lateral view showing the second-transfer-roller shifted to the urging roller of the apparatus shown in FIG. 1.

A shift mechanism of the second-transfer-roller is detailed hereinafter. FIG. 2 is a schematic perspective view illustrating the shift mechanism of the second-transfer-roller of the apparatus shown in FIG. 1. FIG. 3A is a lateral view illustrating a positional relation between the second-transfer-roller held by a holder and the urging roller of the same apparatus. FIG. 3B is a lateral view showing the second-transfer-roller shifted to the urging roller.

In FIG. 2, a pair of holders 11 are rigidly disposed in the chassis (not shown). Both, ends of second-transfer-roller 10 are journaled by a pair of holding blocks. 111 disposed in a sliding manner with respect to holders 11. As shown in FIG. 3A, springs 112 are disposed between respective holding blocks 111 and stoppers 70. The pair of holders 11 journal both ends of driving shaft 121, which is driven by motor 12 shown in FIG. 2, and shaft 121 has a pair of cams 122 for moving holders 11 to both sides as shown in FIG. 3A and FIG. 3B.

FIG. 2 and FIG. 3A show a status of non-printing period, and second-transfer-roller 10 is away from urging roller 60 held on the chassis side in apparatus 1. Both ends of urging roller 60 are journaled by a pair of blocks 211, and coupled to the chassis via a pair of springs 212 linked with blocks 211. On the other hand, FIG. 3B shows a status of printing period. When motor 12 is driven to spin cams 122, holders 11 move in an arrow marked direction as shown in FIG. 3B. This movement urges second-transfer-roller 10 aganist urging roller 60. At this time, as shown in FIG. 1, paper P is nipped between urging roller 60 and intermediate-transfer-belt 7 around the second-transfer-roller 10. Intermediate-transfer-belt 7 has been urged against urging roller 60 by second-transfer-roller 10. At the nipping portion, a toner image formed on belt 7 is transferred onto paper P.

Figure 4A:
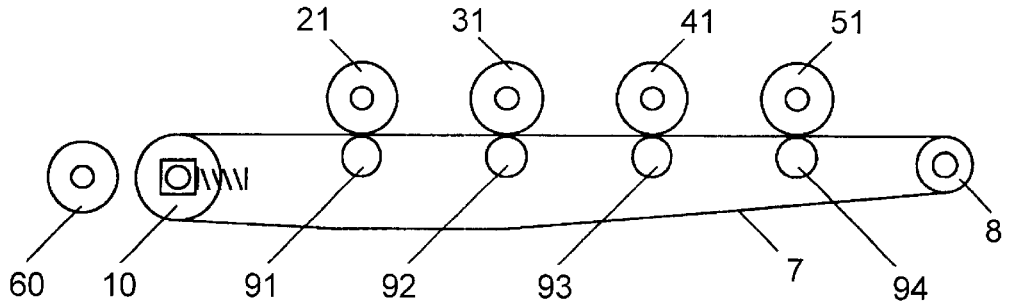
FIG. 4A is a lateral view showing a positional relation between the urging roller and a the intermediate-transfer-belt during a non-printing period in the apparatus shown in FIG. 1.
Figure 4B:
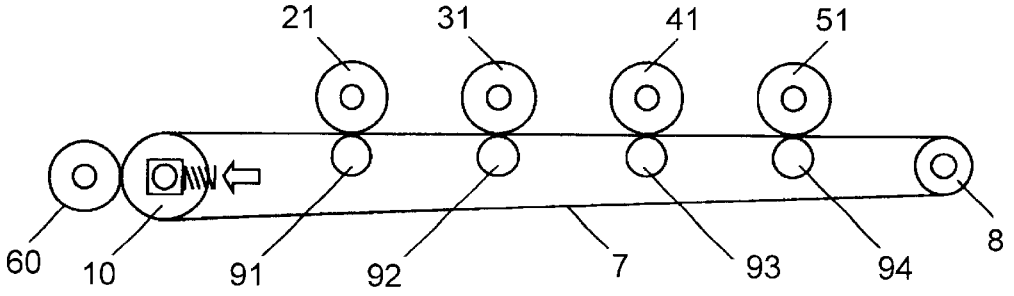
FIG. 4B is a lateral view showing a positional relation between the urging roller and the intermediate-transfer-belt during a printing period in the apparatus shown in FIG. 1.

Next, the tension provided to the intermediate-transfer-belt is described. FIG. 4A shows a lateral view illustrating a positional relation between the urging roller and the intermediate-transfer-belt during the non-printing period of the apparatus shown in FIG. 1. FIG. 4B shows a lateral view illustrating a positional relation between the urging roller and the intermediate-transfer-belt during a printing period in the same apparatus.

During the non-printing period, a position of cam 122 is set as shown in FIG. 3A. Since second-transfer-roller 10 is away from urging roller 60 as shown in FIG. A, tension is not provided to intermediate-transfer-belt 7.

A print instruction drives motor 12, and cam 122 is rotated until it takes a position shown in FIG. 3B, so that holder 11 moves toward urging roller 60. Spring 112 biases second-transfer-roller 10 to urging roller 60. This movement of roller 10 forms a nipping portion between belt 7 around roller 10 and urging roller 60 as shown in FIG. 4B, and belt 7 is pulled so that tension is provided to belt 7. The nipping portion, in general, nips paper P, and urging roller 60 presses second-transfer-roller 10 via paper P and belt 7 during the printing period. In other words, urging roller 60 nips paper P with belt 7 around the second-transfer-roller 10.

In this embodiment, as discussed above, second-transfer-roller 10 is held by holders 11, and urged against urging roller 60 by cams 122, so that a nipping portion is formed between belt 7 around roller 10 and urging roller 60. At the same time, tension is provided to belt 7. Therefore, a tension roller, which the conventional apparatus employs, is not needed, and a driving mechanism for urging the urging roller against the second-transfer-roller is also unnecessary. As a result, the apparatus can be downsized.

Figure 5:
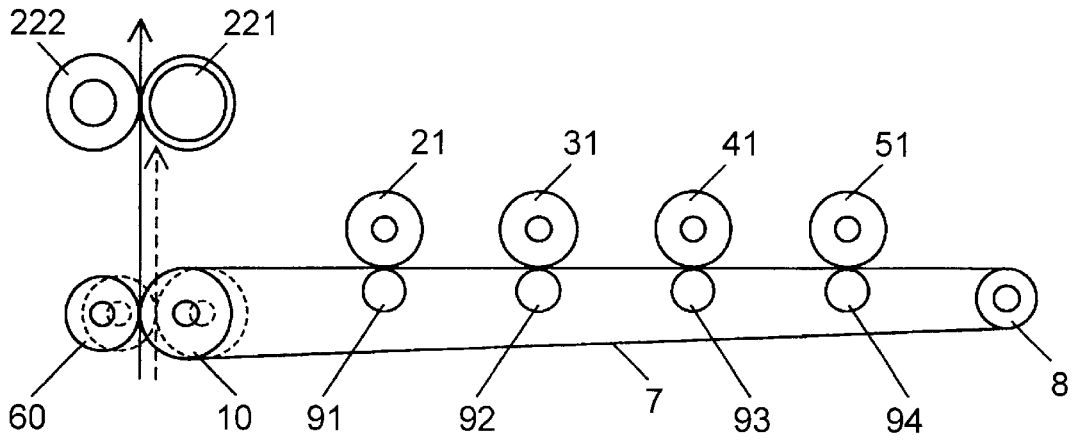
FIG. 5 is a schematic diagram illustrating displacement of a nip portion (first nip section) between the transfer roller and the urging roller due to extension and contraction of the intermediate-transfer-belt in the apparatus shown in FIG. 1.

FIG. 5 is a schematic diagram illustrating displacement of a nip portion between the transfer roller and the urging roller due to extension and contraction of the intermediate-transfer-belt in the apparatus shown in FIG. 1.

In FIG. 1, paper P, on which a toner image has been transferred, travels to fixing device 80 through between belt 7 around roller 10 and urging roller 60. Fixing device 80 comprises heating roller 221 and pressure roller 222. Paper P travels along an arrow mark in a solid line drawn in FIG. 5.

In this case, when a first nipping section between belt 7 wound on second-transfer-roller 10 and urging roller 60 is almost aligned with a second nipping section between heating roller 221 and pressure roller 222, paper P is fed between rollers 221 and 222 smoothly. However, belt 7 extends or contracts due to temperature or the like, and the first nipping section between rollers 10 and 60 sometimes deviates from the aligned position as shown in a broken line. In such a case, paper P hits against outer rim of heating roller 221 and results in jamming.

Figure 6A:
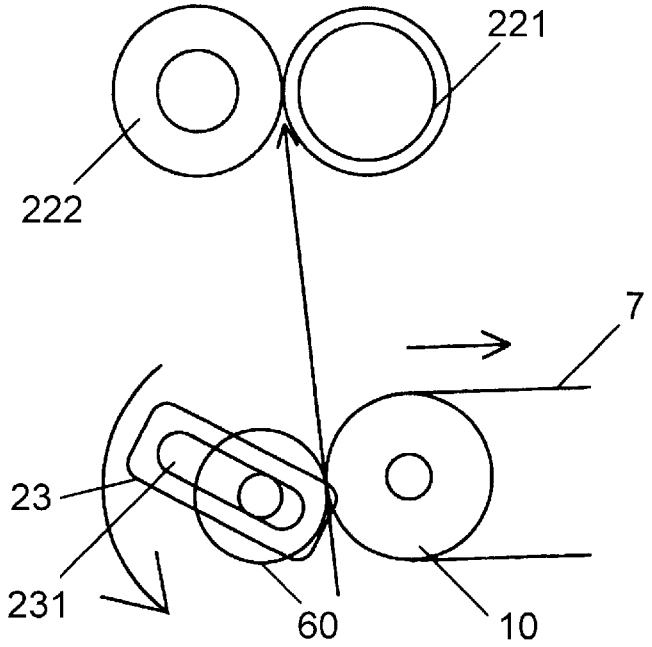
FIG. 6A and FIG. 6B are schematic diagrams illustrating a sheet of paper entering a nip portion (second nip section) between a heating roller and a pressure roller due to displacement of the transfer roller in the apparatus shown in FIG. 1.
Figure 6B:
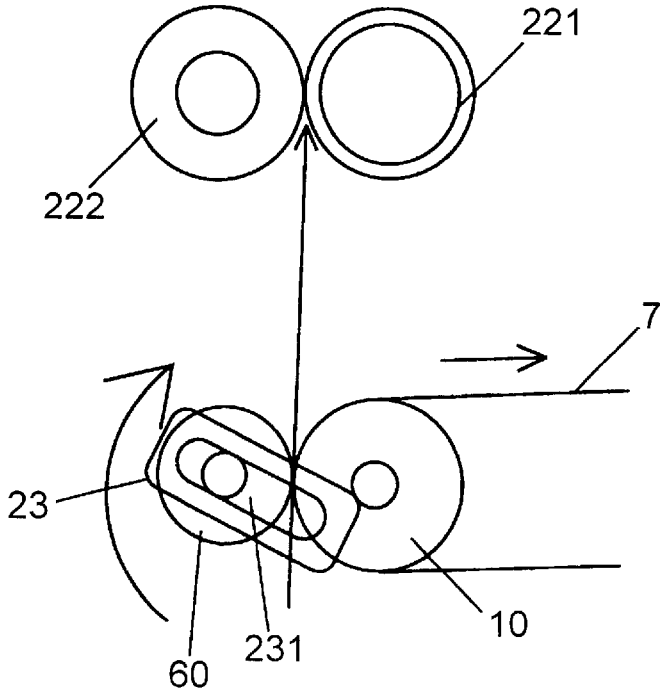

A countermeasure against this jamming is described hereinafter. FIG. 6A and FIG. 6B are schematic diagrams illustrating a sheet of paper entering a nipping portion between the heating roller and the pressure roller due to displacement of the transfer roller in the apparatus shown in FIG. 1.

In FIGS. 6A and 6B, slanted long hole 231 is provided to bearing 23 which journals urging roller 60, and a shaft of roller 60 is movable in this long hole 231. As shown in FIG. 6A, when second-transfer-roller 10 is deviated to the right side with respect to the nipping portion (the second nipping section) between heating roller 221 and pressure roller 222, another nipping portion (the first nipping section) between second-transfer-roller 10 and urging roller 60 deviates to the right side. Then paper P can enter slantingly into the second nipping section. As shown in FIG. 6B, when second-transfer-roller 10 deviates to the left side with respect to the second nipping section, the first nipping section deviates to the left, and paper P can enter slantingly into the second nipping section. As such, even if the second-transfer-roller 10 moves, long hole 231 allows paper P to enter smoothly into the nipping portion between heating roller 221 and pressure roller 222. As a result, the jamming of paper P can be prevented.

As discussed above, according to the present invention, shifting of the transfer roller can provide the intermediate-transfer-belt with tension, thus a conventional tension roller is not required. As a result, a number of components is reduced, which makes assembly easier. The transfer roller can be shifted to the place where the intermediate-transfer-belt wound thereon contacts to the urging roller, a conventional driving mechanism, which removes the urging roller from the belt, is not required. Thus the construction of the apparatus is further simplified.

What is claimed is:

1. A color image forming apparatus comprising:

(a) a plurality of image forming units arrayed, each unit having a photosensitive body carrying a toner image, and each unit forming an image of a different colored toner from each other;

(b) a loop type intermediate transfer belt, disposed allowable to contact to the photosensitive body, and on which the toner image is transferred;

(c) a transfer roller, disposed in the loop of said intermediate transfer belt, for transferring a toner image formed on said belt onto a recording sheet, said transfer roller provides said belt with tension;

(d) a driving roller, disposed in the loop of said intermediate transfer belt and confronting said transfer roller, for rotating said belt, said belt is rotatably held by said transfer roller and said driving roller; and an urging roller, disposed outside the loop of said intermediate transfer belt and confronting said transfer roller, for nipping the recording sheet with said belt, wherein when said transfer roller provides said belt with the tension, said transfer roller and said urging roller urge against each other, and when the tension is released, said urging roller is removed from said transfer roller.

2. A color image forming apparatus comprising:

(a) a plurality of image forming units arrayed, each unit having a photosensitive body carrying a toner image, and each unit forming an image of a different colored toner from each other;

(b) a loop type intermediate transfer belt, disposed allowable to contact to the photosensitive body, and on which the toner image is transferred;

(c) a first transfer roller, disposed in the loop of said belt, for biasing said belt to the photosensitive body;

(d) a second transfer roller, disposed in the loop of said belt, for transferring a toner image formed on said belt onto a recording sheet;

(e) a driving roller, disposed in the loop of said belt and confronting said second transfer roller, for rotating said belt, said belt is rotatably held by said second transfer roller and said driving roller, and said second transfer roller provides said belt with tension;

(f) an urging roller, disposed outside the loop of said belt and confronting said second transfer roller, for nipping the recording sheet at a first nipping section between said belt and said urging roller;

(g) a fixing device, disposed downstream of flow of the recording sheet viewed from the first nipping section, including a heating roller and a pressure roller, wherein said urging roller can change a position thereof responsive to a movement of said second transfer roller for leading the recording sheet into a second nipping section between said heating roller and said pressure roller.

* * * * *